US005414794A

United States Patent [19]

Shao

[11] Patent Number: 5,414,794

[45] Date of Patent: May 9, 1995

[54] QUICKLY-MOUNTABLE SECURING STRUCTURE FOR ELECTRIC HEATING ELEMENT IN A HEATER FAN

[76] Inventor: Steve Shao, 3F, No. 348, Sec. 2, Ming-Chi Rd., Taisan Taipei, Taiwan, Prov. of China

[21] Appl. No.: 141,658

[22] Filed: Oct. 26, 1993

[51] Int. Cl.[6] ..... H05B 3/06

[52] U.S. Cl. ..... 392/365; 219/536

[58] Field of Search ..... 392/360–379; 34/96–101; 219/536, 537

[56] References Cited

U.S. PATENT DOCUMENTS 3,836,749 9/1974 Hubner ..... 392/384

FOREIGN PATENT DOCUMENTS 293997 12/1988 European Pat. Off. ..... 392/360
338604 10/1989 European Pat. Off. ..... 392/385
2497049 6/1982 France ..... 392/360
143691 9/1980 German Dem. Rep. ..... 392/379
2634074 2/1978 Germany ..... 392/360
951947 3/1964 United Kingdom ..... 392/360
2174279 10/1986 United Kingdom ..... 392/361

*Primary Examiner*—John A. Jeffery
*Attorney, Agent, or Firm*—Lowe, Price, Leblanc & Becker

[57] ABSTRACT

A structure for the heating device in a heater fan which can be manufactured quickly and easily and is standardized for mass production consists of a mount which in turn has a rear mesh disk which is separated from a rear casing of the device. The structure is used to replace the metal bracket of a conventional heater fan to secure a plurality of a heat insulating plates, electric heating coil structure and wiring to form an independent heating device structure. The heat insulating plates and rear mesh disk and the rear casing of the heater fan are configured to be assembled quickly and the rear mesh plate is standardized to be adapted to different models of the heater fan.

6 Claims, 3 Drawing Sheets

QUICKLY-MOUNTABLE SECURING STRUCTURE FOR ELECTRIC HEATING ELEMENT IN A HEATER FAN

BACKGROUND OF THE INVENTION (a) Field of the Invention

The present invention relates to an improved design of a heating device for a heater fan, particularly a hater fan in which the electric heating coil and the heat insulating plate are mounted and secured on a separate rear mesh disk.

(b) Description of the Prior Art

The operation of a heater fan is based on the principle that a plurality of electric heating coils are provided in the back side of the fan motor inside the heater fan. The electric heating coils generate the heat source which is drawn by the fan motor, thereby delivering warm air to the room.

The electric heating coils in the conventional heater fans are wired around a plurality of heat insulating plates. Such heat insulating plates are mounted in a metal bracket (1) which has a unique shape, as shown in FIG. 1. The metal bracket (1) consists of several supporting legs (11) each one of which is used for clamping an insulating plate (2). The heat insulating plates (2) are then riveted to the supporting legs (11) by rivets. The inside edge of the metal bracket (1) is provided with protruded circular holes (13) which are used for the fan motor to be mounted onto the metal bracket (1). It is obvious that the manufacturing process of this kind of conventional heating device for the heater fan is slow. The heat insulating plates (2) have to be riveted onto the supporting legs (11) first, and then the electric heating coil is then wound around the heat insulating plates (2) before the fan motor is bolted onto the metal bracket (1). Finally, the control wiring of the heater fan can be connected together.

The inventor deeply feels that it is necessary to improve the heating device structure of the heater fan. The reasons for the improvement include the following:

1. Since the structure of the heating device in the conventional heater fan requires the riveting and bolting in the manufacturing process, it is time consuming and slows down the manufacturing pace.
2. The wiring connection of the heating device in the conventional heater fan must be done within the main body of the heater fan. It is, therefore, more difficult to work on and requires a longer time to complete the wiring connection.
3. The main body of a majority of fans are fabricated by injection molding using polystyrene. The area close to the electric heating coils inside the heater fan is generally hot, and therefore, for safety reason, it requires polystyrene that can withstand higher temperature. The high-temperature polystyrene costs more than the general purpose polystyrene, thereby driving the manufacturing cost to be higher. It is a waste because some area in the main body is not affected by the operating temperature of the heater fan.

Therefore, to overcome the aforesaid drawbacks, the Inventor, after years of design and manufacturing experience, has come up with the new improved design of the heating device which has a separated structure.

SUMMARY OF THE INVENTION

The main object according to the present invention is to provide a heating device structure for a heater fan which has a separated structure with a rear mesh disk. The rear mesh disk is made out of a better-grade material that can withstand a higher temperature, so that the main body of the heater fan can be fabricated from general purpose material. In addition, the rear mesh disk in the back of the casing is eliminated, thereby saving the relatively high cost of tooling and molding.

Another object according to the present invention is to provide a heating device structure for a heater fan, in which the separated structure of the rear mesh disk can be standardized. The heating structure can be adapted and assembled into different models of heater fans. Therefore, the assembly of the heater fan can be simplified.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE PREFERRED EMBODIMENT

Figure 1:
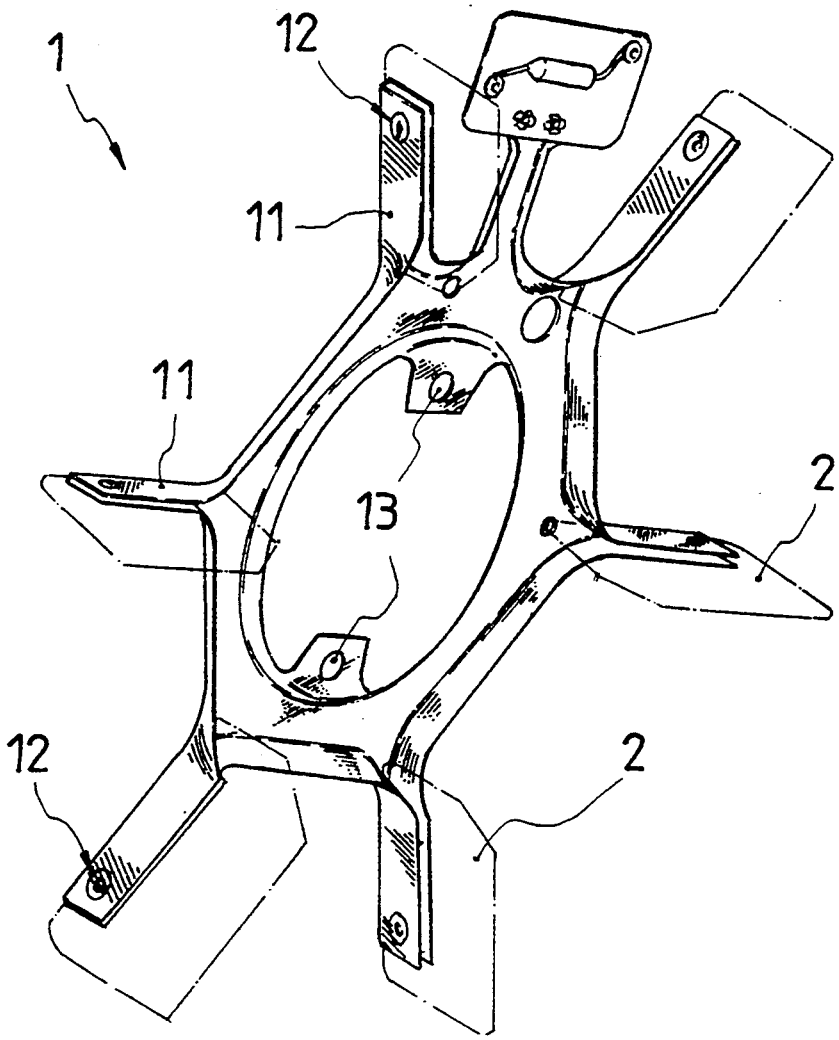
FIG. 1 (PRIOR ART)
FIG. 1 shows the metal bracket portion of the heating device of a conventional heater fan.
Figures 2, 2A:
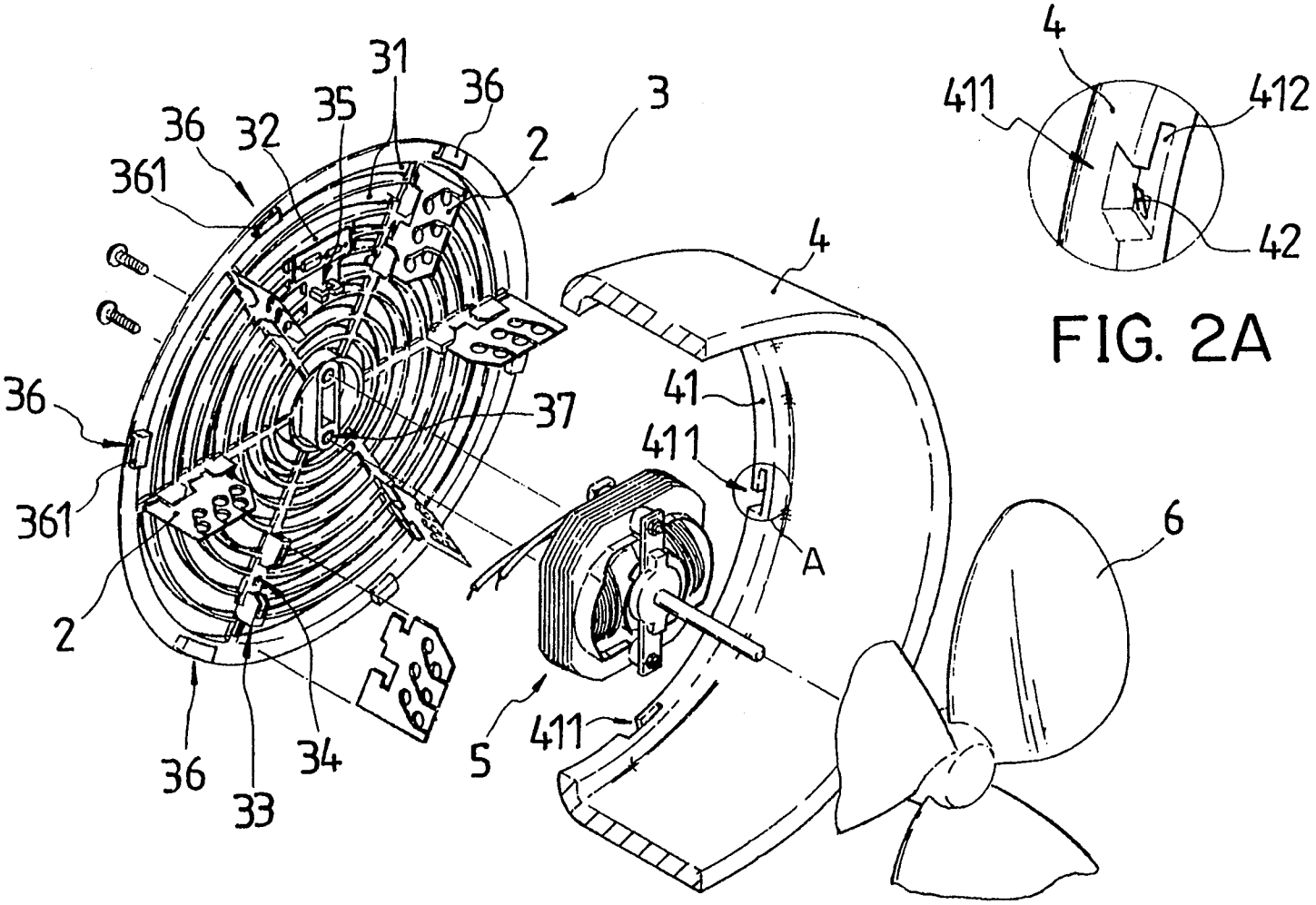
FIG. 2 is an exploded fragmentary view of a preferred embodiment according to the present invention.
FIG. 2A is a detail taken along Circle A of FIG. 2.

As shown in FIG. 2, the heating device for the heater fan according to the present invention mainly consists of a rear mesh disk (3), a plurality of heat insulating plates (2) which can be attached to the rear mesh disk (3), electric heating coils and associated wiring. The electric heating coils and associated wiring of the heating device are similar to that of the conventional structure, it is, therefore, not an issue to be discussed here. In order to simplify the drawings and not to cause any complication, the electric heating coils and the associated wiring are not drawn out either. It is understood that the electric heating coils are wound around the heat insulating plates (2). The 'on' and 'off' of the electric heating coils can be controlled by the control switch of the heater fan and its associated wiring. Therefore, the rear mesh disk (3) of the heating device according to the present invention is provided with a positioning hook (35) for the wiring to bundle together so as to give a neat appearance. In addition, a fuse and a temperature control switch shall be added to the wiring to enhance the overall safety feature of the heater fan.

Figure 3:
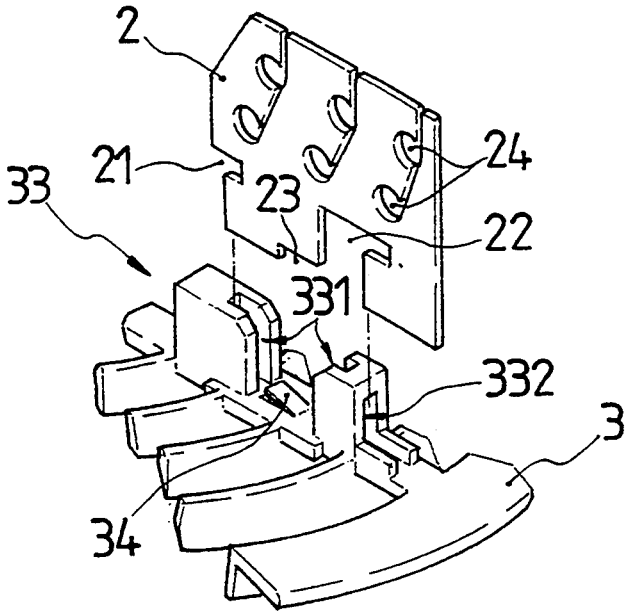
FIGS. 3A and 3B are respectively a partial perspective view and a cross-sectional view of the heat insulating plate and the protruded base according to the present invention.
Figure 3:
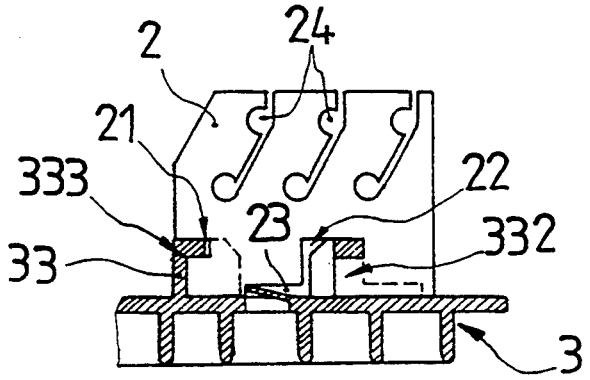

As mentioned in the previous paragraph, the heating device according to the present invention is a separated type. Therefore, the rear mesh disk (3) is provided which has a standard format. As long as the rear casing (4) of the heater fan is provided with a frame (41) to cooperate with the rear mesh disk (3), the latter can be adapted to be used in different models in the manufacturing of the heater fan. Hence, the rear mesh disk (3) is made out of a better-grade material that can withstand a higher temperature, the rest of the heater fan body that are not in the vicinity of the heat source can be fabricated from general purpose material. Therefore, the material cost of the heater fan can be brought down lower. Moreover, the structure of the rear casing (4) can be simplified so as to lower the tooling cost and the molding cost in manufacturing. The surface of the rear mesh disk (3) is provided with stencil holes (31) for the fan (6) to draw the air flow. An appropriate surface (32) is reserved in the rear mesh disk (3) for holding the fuse and the temperature control switch in place. In addition, in order to secure the individual heat insulating plate in place, the rear mesh disk (3) is also provided with a plurality of protruded bases (33) which are used to secure the heat insulating plates (2) in place quickly. A design of the protruded base (33) is shown in FIG. 3A. A plurality of members of the protruded bases (33) are provided at the central portion of the rear mesh disk (3). If the orientation towards the center of the rear mesh disk (3) is internal, and the orientation away from the center of the rear mesh disk is external. Elongated gaps (331) and (332) that communicate with each other are provided in each of the protruded bases (33) in the upper side and in the side surface facing the internal direction close to the external edge. The elongated gaps (331) and (332) are provided for the insertion of the heat insulating plate (2) so that the later is secured in place and will not tilt. The gap (331) in the upper side surface stretches and turns to the inside of the protruded base (33) forms a stepping member (333), as shown in FIG. 3B. Therefore, the heat insulating plates (2) which are to be inserted into the gaps (331) and (332) of the protruded bases (33) are provided with appropriate deflected openings (21) (22). This allow the heat insulating plate (2) to be secured with the protruded base (33) when the former is inserted into the later. The deflected openings (21) and (22) prevent the heat insulating plate (2) from coming out. Also a resilient plate (34) extends towards the internal direction in an appropriate location in the center of the protruded base (33). Also, a slot (23) is opened in a corresponding location in the heat insulating plate (2) such that the resilient plate (34) is pressed down by the heat insulating plate (2) when the heat insulating plate is being inserted into the protruded base (33). Thus the insertion of the heat insulating plate (2) is not affected. When the heat insulating plate is positioned in the protruded base, the slot (23) provides a holding means so as to prevent the heat insulating plate (2) from coming out. Normally, the electric heating coil generates a pulling force towards the inside when the heat insulating plate (2) is wound with electric heating coil. At this time the resilient plate (34) has a minimum effect on the heat insulating plate. Thus, before the heat insulating plate (2) is wound with the electric heating coil, the resilient plate (34) mainly is used to prevent the disengagement of the heat insulating plate (2) from the rear mesh disk (3) during the assembly process. In addition, the center of the rear mesh disk (3) is provided with two screw holes (37) through which the fan motor (5) can be screwed on with screws. A fan blade (6) is then assembled to the fan motor (5) to complete the main structure of the heating device of the heater fan. To sum up, the separated structure formed by the rear mesh disk (3) and the main body of the heater fan can be pulled out by itself. This independent structure is used to replace the metal bracket (1) of the conventional heater fan. Therefore, the rear mesh disk (3) can be assembled as a complete unit in an assembly line. Manufacturing quality control and testing can be done independently on the heating devices according to the present invention. They are then adapted to different models of heater fans for assembly.

The heat insulating plates (2) are generally made out of mica and they have the shape of thin plate. In addition to the openings (21), (22) and the slot (23) in the heat insulating plate (2), a plurality of circular holes (24) are provided for windings of the electric heating coils. The quantity of the circular holes is determined by the number of turns of the windings of the electric heating coil.

The connection of the rear mesh disk (3) and the rear casing (4) of the heater fan provides a means of quick assembling by using the assembled parts. As shown in FIG. 2, the circumference of the rear mesh disk (3) is provided with a plurality of clips (36) which are protruded upward. Each of the clip (36) consists of a clip member (361) which is movable. The frame (41) of the rear casing (4) is also provided with a corresponding number of retaining slots (411). A partially exposed line slot (412) is also provided in the inside of each of the retaining slots (411). Thus each of the clips (36) of the rear mesh disk (3) can first be clipped onto the corresponding retaining slot (411), the clip member (361) is then quickly turned into the line slot (412) for securing. At the same time, a uni-directional protruded resilient plate (42) is also provided in the retaining slot (411), as is shown in FIG. 2A. After the clips (36) are secured into the corresponding retaining slots (411), they are secured together based on the same principle as mentioned earlier. It is necessary to bring out that this is only a preferred embodiment and is not the only one. There are certainly a lot of other quick-connecting means that can be applied to the assembling of the rear mesh disk (3) and the rear casing (4) of the heater fan.

Finally, the heating device for a heater fan according to the present invention is hereby summarized:

1. The rear mesh disk (3) and the main body of the heater fan are separated from each other before the assembly and therefore, a different type of heat-resistant material can be used for manufacturing. Thus, the manufacturing cost is lower. In addition, the rear casing (4) of different models of heater fans are simplified, thereby the molding and tooling cost for manufacturing are lower, too.
2. The heat insulating plate (2) and the rear mesh disk (3) as well as the rear mesh disk (3) and the rear casing (4) of the heater fan can easily and quickly be assembled together, thereby the time to produce the heater fan unit is lower and the production efficiency is enhanced.
3. Since the rear mesh disk (3) is separated from the rear casing (4), a hollow frame (41) must be provided such that the front and the back sides of the rear casing (4) are vacant. This makes it convenient for the assembler to wire up the heater fan unit, thereby expediting the manufacturing process.
4. The rear mesh disk (3) according to the present invention has a standard format, which can be manufactured and tested independently. It can also be adapted into different models of heater fans.

The foregoing description of the preferred embodiment of the invention has been presented for the purpose of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A heating device structure having a rear casing for mounting a heater and fan of a heater fan combination comprising:

a rear mesh disk;

a plurality of heat insulating plates, which are secured in said rear mesh disk;

said plates being adapted to mount an electric heating coil and its associated wiring; said rear mesh disk being adapted to be quickly mounted in a frame in said rear casing of a heater fan so as to form a complete unit, the surface of the rear mesh disk being provided with stencil holes to allow air flow, and further including a plurality of protruded bases for securing the heat insulating plates; each of the protruded bases of the rear mesh disk have a block shade that protrudes upward, each of said protruded bases further having elongated gaps that communicate with each other, said elongated gaps being provided for the insertion of the heat insulating plates for securing said heat insulating plates in place, the inside of each of the gaps being provided with a stepping member corresponding to the insert portion of the heat insulating plate, a uni-directional protruded resilient plate being further provided adjacent each protruded base, and a slot corresponding to the base being provided in the corresponding insert portion of the heat insulating plate whereby when the slot in the heat insulating plate receives the protruded base to engage said plates and base, the resilient plate will function to prevent the disengagement thereof wherein when an electric heating coil is wound around the heat insulating plates, and is connected to the heater fan a heating device structure will be provided which is convenient to assemble and economical to produce.

2. An improved heating device structure for a heater fan as recited in claim 1 wherein the circumference of the rear mesh disk is provided with a plurality of clips which protrude upwardly, each of the clips consisting of a clip member which is movable, the frame of the rear casing being also provided with a corresponding number of retaining slots, a partially exposed line slot being provided in the inside of each of the retaining slots whereby each of the clips of the rear mesh disk can first be clipped onto the corresponding retaining slot, whereby the clip member may be quickly turned into the line slot for securing thereof.

3. An improved heating device structure for a heater fan as recited in claim 2 further comprising a uni-directional protruded resilient plate provided in each of the frame retaining slots so that when the clip is secured in the retaining slot, the clip is prevented from disengagement therewith.

4. A heating device structure for heater fan as recited in claim 1 characterized in that a surface without any stencil hole is provided in the rear mesh disk, said surface being adapted to the mounting of a fuse and a temperature control switch.

5. A heating device structure for heater fan as recited in claim 1 characterized in that a wiring positioning hook is provided in the rear mesh disk.

6. A heating device structure for heater fan as recited in claim 1 wherein the center of the surface of the rear mesh disk is provided with screw holes for the mounting of a fan motor.

* * * * *